US005197459A

United States Patent [19]

Henkin et al.

[11] Patent Number: 5,197,459

[45] Date of Patent: Mar. 30, 1993

[54] ELECTRIC PUMP POWERED SUBMERGIBLE HAND HELD HYDROTHERAPY APPARATUS

[76] Inventors: Melvyn L. Henkin, 5011 Donna Ave., Tarzana, Calif. 91356; Jordan M. Laby, 3038 Bayshore, Ventura, Calif. 93001

[21] Appl. No.: 688,043

[22] Filed: Apr. 19, 1991

[51] Int. Cl.[5] ..... A61H 9/00

[52] U.S. Cl. ..... 128/66; 4/541.6; 4/541.4

[58] Field of Search ..... 128/64, 66, 65, 38, 128/39, 40; 4/542; 15/29

[56] References Cited

U.S. PATENT DOCUMENTS

| | | | |
|---|---|---|---|
| 3,530,852 | 9/1970 | Fattor | 128/66 |
| 3,868,949 | 3/1975 | Arneson | 128/66 |
| 3,910,265 | 10/1975 | Coleman | 128/66 |
| 4,100,917 | 7/1978 | Talge | 128/66 |
| 4,139,001 | 2/1979 | Macabee | 128/66 |
| 4,414,695 | 11/1983 | Hart | 128/66 |
| 4,432,355 | 2/1984 | Delluc | 128/66 |
| 4,441,488 | 4/1984 | Macabee | 128/66 |
| 4,715,071 | 12/1987 | Henkin | 128/66 |
| 4,726,080 | 2/1988 | Henkin | 128/66 |
| 4,736,367 | 8/1988 | Henkin | 128/66 |
| 4,926,510 | 5/1990 | Watkins | 128/64 |
| 5,007,127 | 4/1991 | Paolo | 15/29 |
| 5,027,450 | 7/1991 | Lang | 4/542 |
| 5,031,256 | 7/1991 | Mikiya | 4/542 |
| 5,065,463 | 11/1991 | Le | 15/29 |

FOREIGN PATENT DOCUMENTS

| | | | |
|---|---|---|---|
| 2176114 | 12/1986 | United Kingdom | 128/57 |

*Primary Examiner*—Robert A. Hafer
*Assistant Examiner*—David Kenealy
*Attorney, Agent, or Firm*—Freilich Hornbaker Rosen

[57] ABSTRACT

A submergible hydrotherapy apparatus powered by an electric pump and configured to be held in user's hand for discharging a water stream underwater for massaging the user's body.

9 Claims, 7 Drawing Sheets

ELECTRIC PUMP POWERED SUBMERGIBLE HAND HELD HYDROTHERAPY APPARATUS

FIELD OF THE INVENTION

This invention relates to a submergible hydrotherapy apparatus powered by an electric pump and configured to be held in a user's hand for discharging a water stream underwater for massaging the user's body.

RELATED APPLICATIONS

Applicants' copending application no. 688,292 filed Apr. 22, 1991 discloses a hand held tap water powered water discharge apparatus.

BACKGROUND OF THE INVENTION

Many different hydrotherapy structures are disclosed in the prior art for massaging a user's body. For example only, is directed to applicants' following U.S. patents and the references cited therein:

| | |
|---|---|
| 4,679,258 | 4,731,887 |
| 4,689,839 | 4,763,367 |
| 4,692,950 | 4,813,086 |
| 4,715,071 | 4,825,854 |
| 4,726,080 | 4,965,893 |
| 4,727,605 | 4,982,459 |

The foregoing patents primarily disclose assemblies intended for mounting in a water tub wall for discharging a water stream through a discharge orifice. Some of the disclosed assemblies are configured so that the discharge orifice moves along a defined or random travel path so that the stream impacting against the user's body describes an area.

Various other hydrotherapy devices are disclosed in prior patents and/or are commercially available. One such unit marketed by HydroAir Industries under the mark HYDROWAND comprises a hand held tubular member mounted at the end of a dual lumen flexible hose. The dual lumens respectively carry pressurized water and air to the tubular member which is capable of discharging a water/air stream underwater for impacting against a user's body.

SUMMARY OF THE INVENTION

The present invention is directed to electric pump powered submergible hand held apparatus for discharging a water stream underwater for massaging a user's body.

Apparatus in accordance with the invention includes a housing configured to be held in a user's hand and mounted on the free end of a flexible hose. A fixed end of the hose is coupled to a fitting mounted on the wall of a water tub. An electric pump mounted proximate to the water tub pulls water from the tub and supplies it under pressure to the fitting for flow through the hose to a nozzle in the housing. The nozzle discharges a water jet into a cavity to create a suction therein. An air port in the cavity, coupled to an air lumen, enables the suction to draw air into the cavity for mixing with the water jet discharged from the nozzle.

In accordance with one aspect of the present invention, the housing includes a tub water inlet which communicates with a tub water port opening into the cavity. As a consequence, the suction in the cavity is able to draw water directly from the tub for mixing with the water jet discharged from the nozzle. The housing preferably incorporates valve means enabling the user to selectively open either the air port (to cause air entrainment) or the tub water port (to cause water entrainment).

In accordance with a first embodiment of the invention, the housing defines a fixed discharge orifice communicating with the cavity for discharging a water stream (including either entrained air or tub water) therefrom.

In accordance with a second embodiment of the invention, the housing defines a discharge orifice which moves along a travel path as the water stream is discharged therefrom.

In accordance with a further aspect of the invention, at least one protuberance extends from the housing proximate to the discharge orifice for placement against a user's body to space the discharge orifice therefrom and thus prevent occlusion of the water stream discharged from the discharge orifice.

In accordance with a valuable feature of the second embodiment, the protuberance is configured with a substantially smooth surface for engaging the user's body. As the discharged water stream propels the discharge orifice along its travel path, forces reacting to the discharge act on the unit to move the protuberance and thus mechanically massage the user's body to supplement the hydromassage produced directly by the discharged water stream.

DETAILED DESCRIPTION

Figure 1:
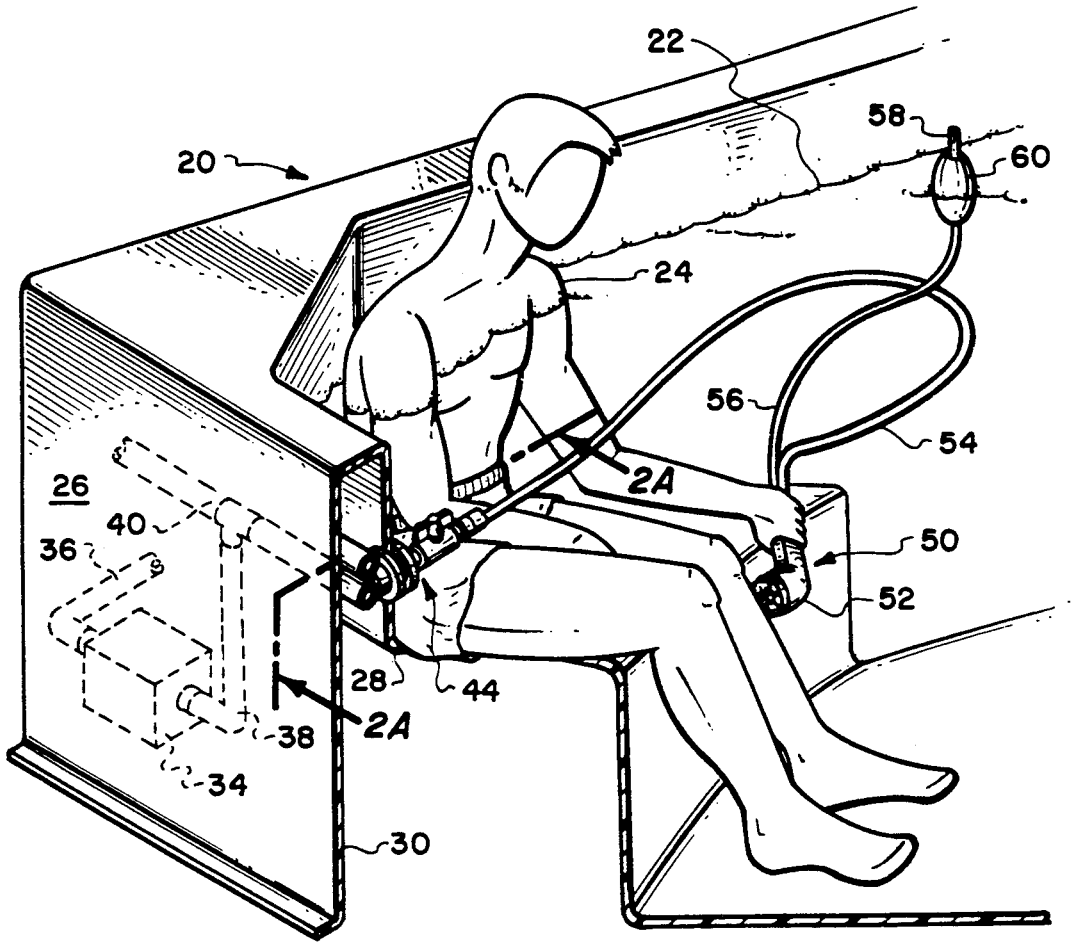
FIG. 1 is an isometric view of a user in a water tub depicting a typical installation of an embodiment of the present invention.

Attention is now directed to FIG. 1 which illustrates an exemplary water tub 20 for accommodating a pool of water 22 in which a user 24 can sit. The water tub includes a wall 26 having inner and outer wall portions 28 and 30. As is typical, an electrical driven pump 34 is mounted within the outer wall portion 30. The suction side 36 of the pump 34 draws water from the pool 22 delivering it to the pump pressure side 38. The pressure side 38 is connected to a water supply manifold 40. The water supply manifold 40 extends around the periphery of the inner wall portion 28 and is coupled to one or more wall fittings, e.g. wall fitting 44 depicted in FIG. 2A, for discharging a water stream into the tub pool 22 for impacting against the body of user 24.

The present invention is directed primarily to hydrotherapy apparatus 50 in the form of a hand held unit 52 which can be held by the user 24 enabling him to discharge a water stream against various parts of his body. Note that the hand held unit 52 is connected to the end of a flexible water supply hose 54 which receives pressurized water from the pump 34 via the fitting 44. Additionally, a first end of an air hose 56 is also connected to the hand held unit 52. A second end 58 of the air hose 56 is maintained open to the air, as by a float 60.

Figure 2A:
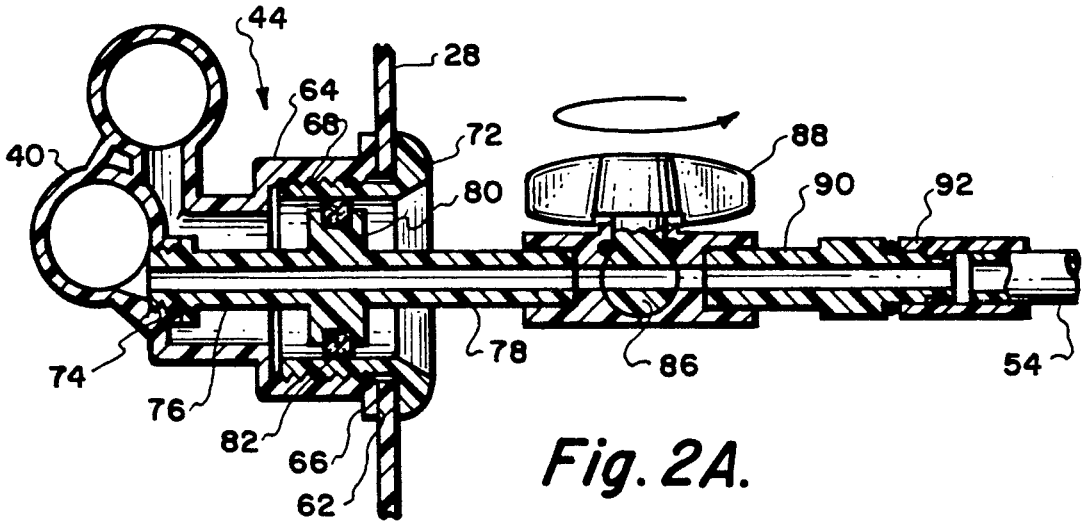
FIG. 2A is a sectional view taken substantially along the plane 2A—2A of FIG. 1 depicting one form of wall fitting.

FIG. 2A illustrates the fitting 44 mounted in an opening 62 in inner wall portion 28. Note that the fitting 44 includes an inner tubular member 64 having a flange 66. The tubular member 64 is internally threaded at 68 and receives an externally threaded outer tubular member 70 having a front flange 72. Note that when outer tubular member 70 is threaded into inner tubular member 64, inner wall portion 28 is clamped between flange 66 and flange 70. This action retains the fitting 44 within the opening 62 in wall member 28.

Water supply manifold 40, as depicted in FIG. 2A, communicates with a threaded tubular boss 74. A short pipe section 76 extends from the threaded boss 74 through the tubular members 64 and 70 into the tub at 78. A flange 80 on the pipe section 76 cooperates with seal 82 for preventing the intrusion of the tub pool water into tubular member 64. The inner end 78 of pipe section 76 is coupled to a main water supply valve 86 having a user operable knob 88. The downstream end of valve 86 accommodates a short pipe section 90 which is coupled, via bayonet coupler 92, to the aforementioned water supply hose 54. Note that the supply hose 54 in FIG. 2A comprises a single lumen for carrying water only. The hose 56 depicted in FIG. 1 defines a second lumen for carrying air to the hand held unit 52.

Figure 2B:
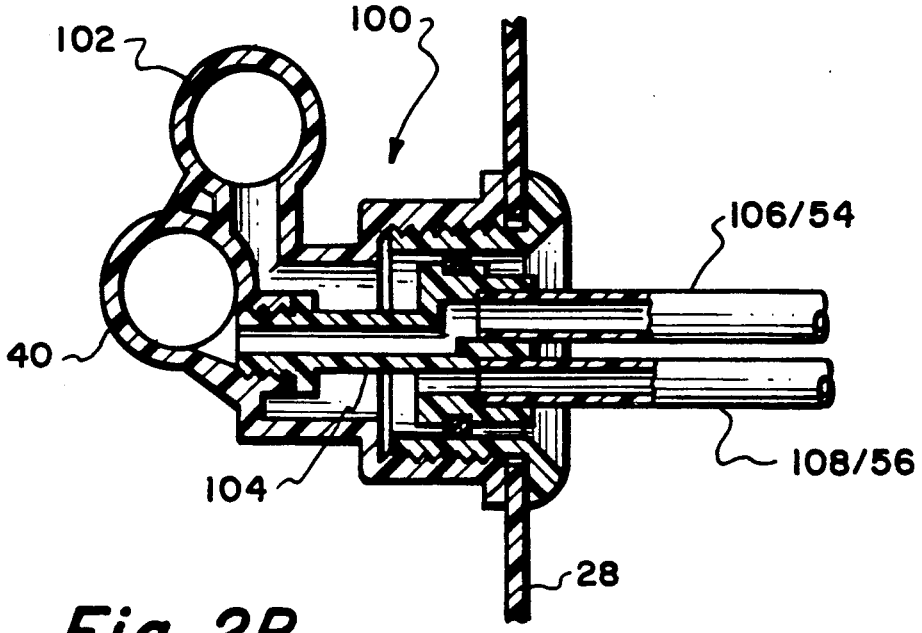
FIG. 2B is a sectional view, similar to FIG. 2A, depicting an alternative form of wall fitting accommodating a dual lumen hose.

FIG. 2B depicts an alternative wall fitting 100 which utilizes, in addition to water supply manifold 40, an air supply manifold 102. In the fitting 100, the water supply manifold 40 is coupled via threaded insert 104, to a water lumen 106. The air manifold 102 is coupled to an air lumen 108. Utilizing the fitting 100 of FIG. 2B, water and air can be supplied to the hand held unit 52 directly from the wall fitting, thereby eliminating the need for the float 60 and the open lumen end 58 depicted in FIG. 1.

Figure 3:
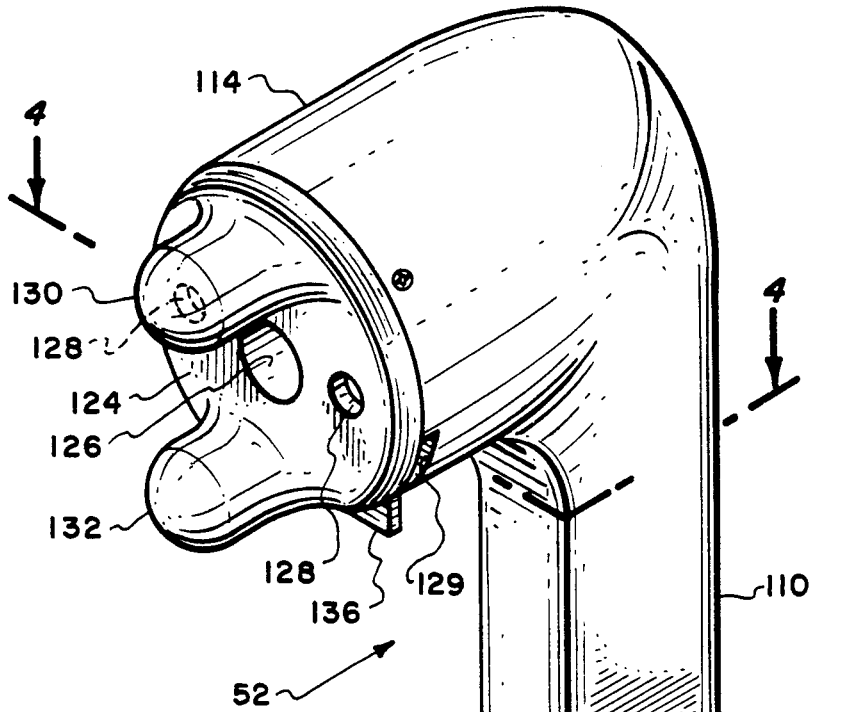
FIG. 3 is an isometric view of a hand held unit comprising a first embodiment of the present invention.
Figure 4:
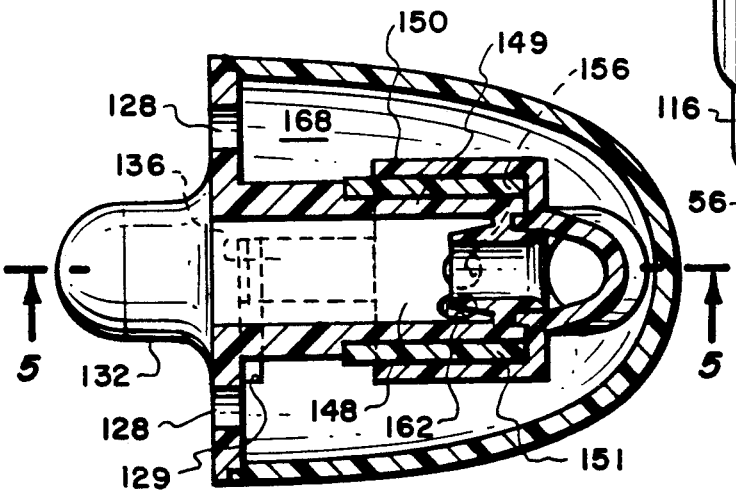
FIG. 4 is a sectional view taken substantially along the plane 4—4 of FIG. 3.

Attention is now directed to FIG. 3 which shows the exterior of the hand held unit 52, showing the water lumen 54 and air lumen 56 connected thereto. Note that the hand held unit 52 can be used with either the single lumen fitting shown in FIG. 2A with the supplemental air hose 56 as depicted in FIG. 1 or with the dual lumen fitting 100 depicted in FIG. 2B.

With continuing reference to FIG. 3 note that the hand held unit 52 comprises a housing 110 configured to essentially define a handle portion 112 and a head portion 114. The housing 110 comprises a sealed unit except for specific openings formed therein to be described hereinafter. Before proceeding to a description of FIGS. 4–9 which show the inner construction of housing 110, certain externally appearing elements of the hand held unit 52 should be noted in FIG. 3. Initially, note that the lumens 54 and 56 enter the housing 110 at its lower end through a water inlet 115 and an air inlet 116, respectively. The housing 110 carries a water supply valve member 118 having an externally mounted user accessible control knob 120. As will be seen hereinafter, the user can operate valve member 118 to control the flow of pressurized water to the unit 52.

The housing head portion 114 defines various openings into the otherwise sealed housing 110. Particularly note that the head portion 114 terminates in a substantially flat plate 124 at its forward end which defines a central opening 126, comprising a water stream discharge orifice, and openings 128 comprising tub water inlets. A further tub water inlet is defined by slot 129.

Projecting forwardly from the plate 124 are first and second protuberances 130 and 132. A significant purpose of the protuberances 130 and 132 is to assure that the discharge orifice 126 not placed directly against the user's body in a manner which would occlude the water stream discharged therefrom. That is, it is intended that the protuberances 130 and 132 engage the user's body to space the discharge orifice 126 therefrom so as to assure free flow of the water stream from the discharge orifice.

Figure 6:
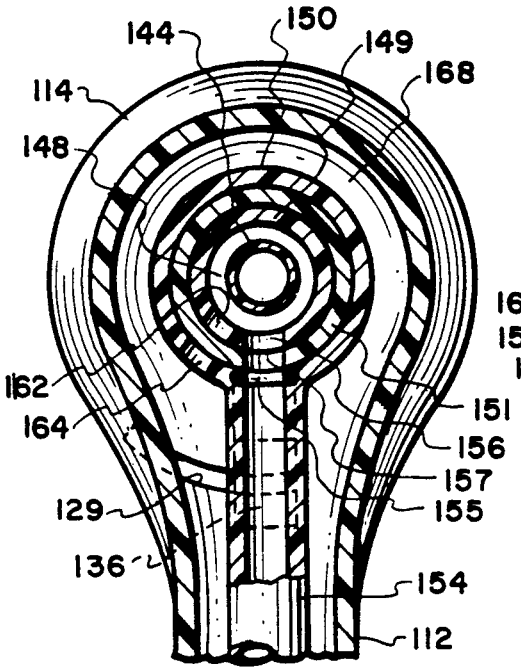
FIG. 6 is a sectional view taken substantially along the plane 6—6 of FIG. 5 showing the entrainment mode valve in the air entrainment mode position.
Figure 7:
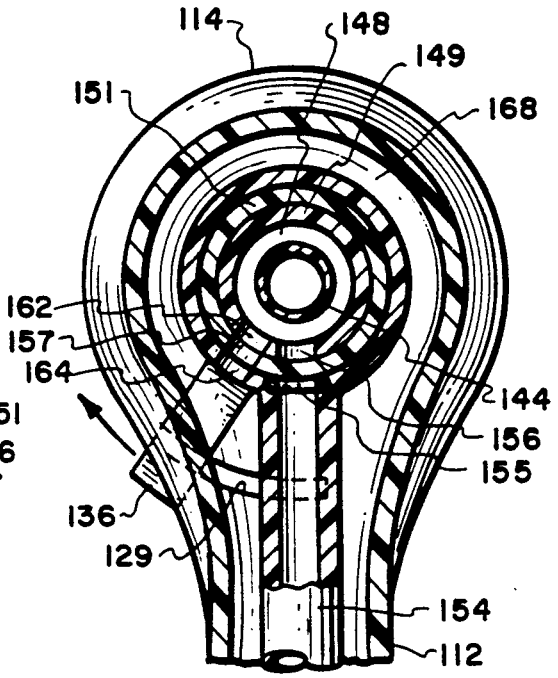
FIG. 7 is a sectional view, similar to FIG. 6, showing the valve member in the tub water entrainment mode position.

As will be seen hereinafter, the hand held unit 52 includes an entrainment made selector valve having a control handle 136 for enabling the user to selectively entrain either air (air entrainment mode) derived from air lumen 56 or tub water (tub water entrainment mode) derived from tub water inlets 128 in the water stream discharged from orifice 126. FIGS. 6 and 7 show the handle 136 in two different positions for respectively selecting the two different entrainment modes.

With continuing reference to FIGS. 4–9, note that the water supply hose 54 communicates past the water supply valve 118 with a tubular member 140. The tubular member 140 at its upper end opens in to the entrance 142 of a nozzle 144. The nozzle 144 defines an exit port 146 opening into a cavity 148 defined by a substantially cylindrical wall 149. The cavity 148 extends to and is open at the aforementioned discharge orifice 126.

The substantially cyndrical cavity wall 149 is supported coaxially within a substantially cylindrical support wall 150. An apertured cylindrical valve member 151 of the aforementioned entrainment mode selector valve is mounted for rotation between cavity wall 149 and support wall 150.

Water supplied under pressure via the lumen 54 and the tubular member 140 exits through the reduced diameter nozzle 144 to produce a negative pressure or suction in the cavity 148. As will be seen hereinafter, this suction is used to entrain air supplied to the cavity 148 from air lumen 56 or tub water supplied to the cavity via inlet 128.

More particularly, the housing 110 includes an additional tubular member 154 which extends from the air inlet 116 to opening 155 in support wall 150. Opening 155 is aligned with air port 156 formed in the cavity wall 149. The rotatable valve member 151 defines an aperture 157 for selectively coupling opening 155 to air port 156.

Also defined in the cavity wall 149 is a tub water port 162 (FIGS. 6,7). This port 162 is aligned with opening 164 in support wall 150. Opening 164 communicates with chamber 168 which in turn is open to the tub water pool 22 via the aforementioned tub water inlets 128 and 129.

The valve member 151 defines a single aperture 157 which can be selectively aligned with either (1) air opening 155 and air port 156 (FIG. 6) or (2) with tub water port 162 and tub water wall opening 164 (FIG. 7). More specifically, note that the handle 136 of valve member 151 extends through the tub water inlet slot 129 in housing 110. By use of the handle 136, the user 24 is able to selectively move the valve member 151 from the air entrainment position depicted in FIG. 6, to the tub water entrainment position depicted in FIG. 7, or vice versa. With the entrainment selector valve in the air entrainment position (FIG. 6), the suction produced in cavity 148 by the water jet exiting from nozzle 144 will entrain air, drawn from tubular member 154 to enable discharge orifice 126 to discharge a water stream having air mixed therein.

On the other hand, when the entrainment mode selector valve member 151 is moved to the tub water entrainment position (FIG. 7), tub water will be entrained by the water jet exiting nozzle 144, the tub water entering the cavity 148 via opening 164, valve aperture 157, and tub water port 162.

As has been discussed in Applicants' previously issued patents, different users at various times may prefer different hydromassaging effects attributable to air entrainment on the one hand, and tub water entrainment on the other. The introduction of air into the water stream discharged from discharge orifice 126 produces a more traditional bubbling and massaging effect but tends to cool the temperature of the discharged water stream and, ultimately the temperature of the entire water pool 22. Operation in the tub water entrainment mode produces a similar massaging effect while minimizing the amount of temperature reduction.

Figure 8:
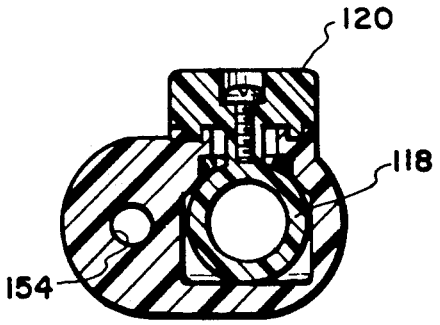
FIG. 8 is a sectional view taken substantially along the plane 8—8 of FIG. 5 showing the water supply valve in an open position.
Figure 9:
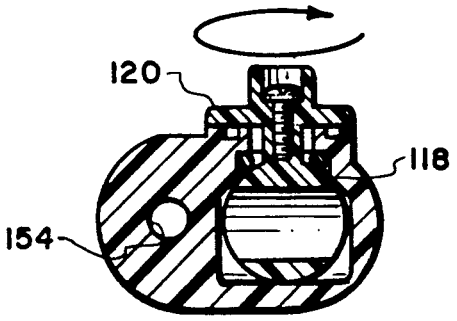
FIG. 9 is a sectional view similar to FIG. 8 showing the water supply valve in a closed position.

FIGS. 8 and 9 respectively show the water supply valve 118 in an open position (FIG. 8) and a closed position (FIG. 9). The placement of the water supply valve 118 on the handle portion 112 of the unit 52 very much facilitates use of the unit underwater.

Figure 12:
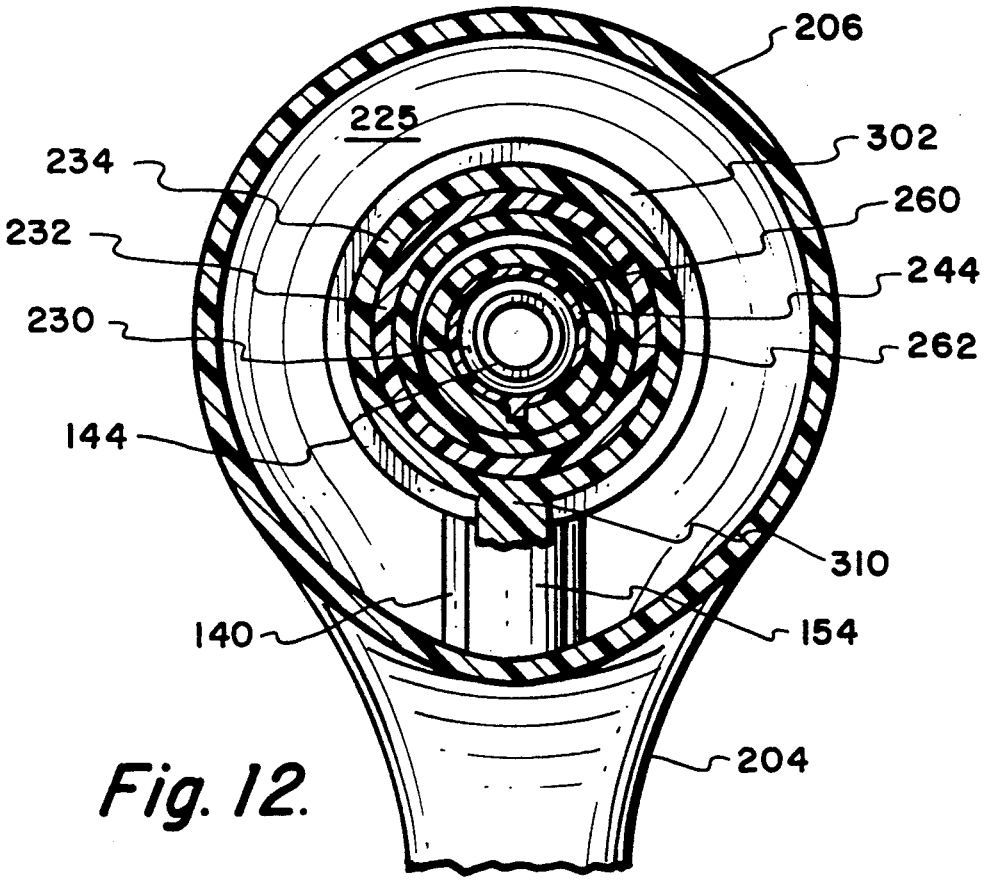
FIG. 12 is a sectional view taken substantially along the plane 12—12 of FIG. 11.
Figure 10:
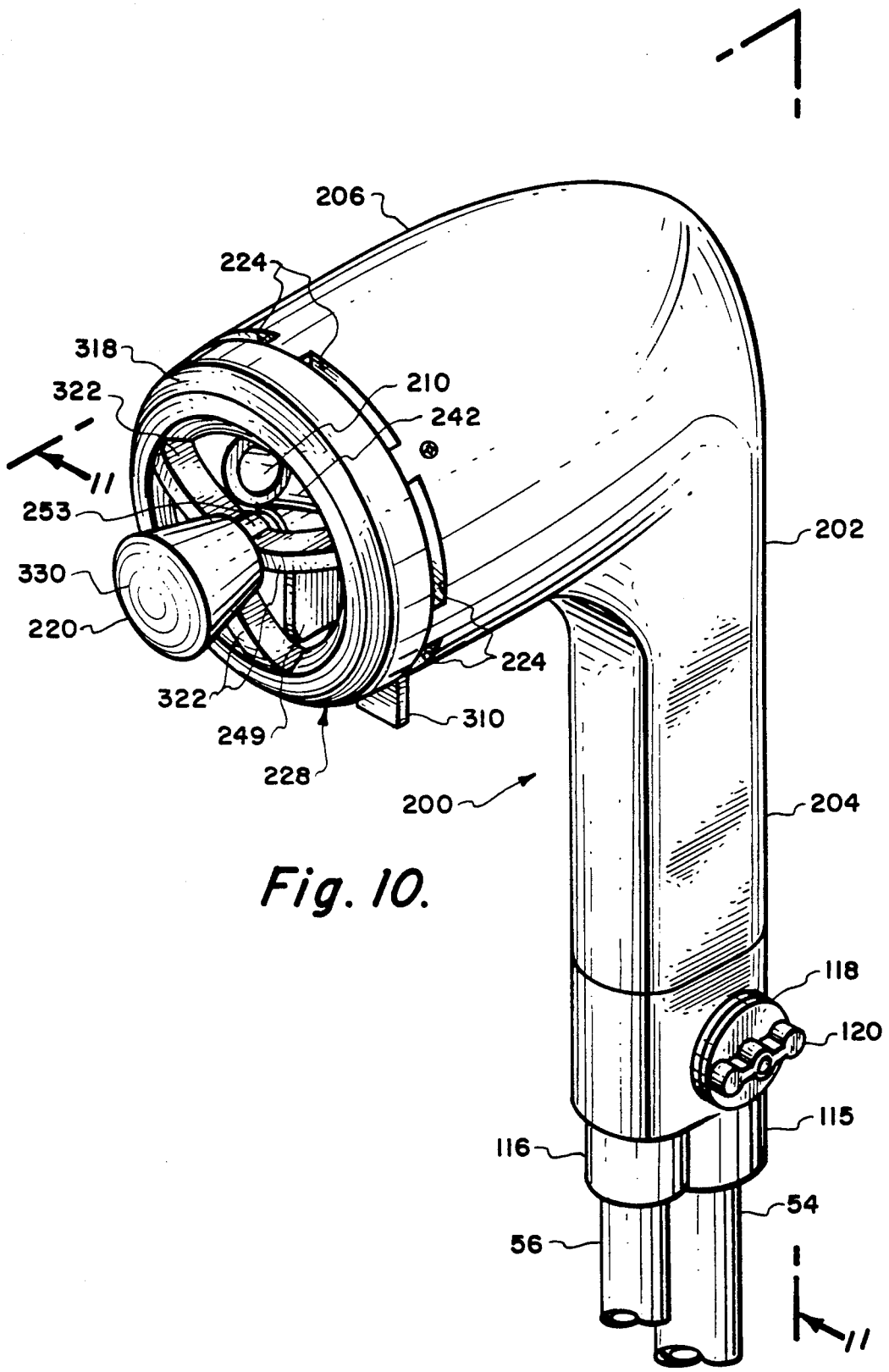
FIG. 10 is an isometric view of an alternative embodiment of the present invention incorporating a travelling discharge orifice.
Figure 11:
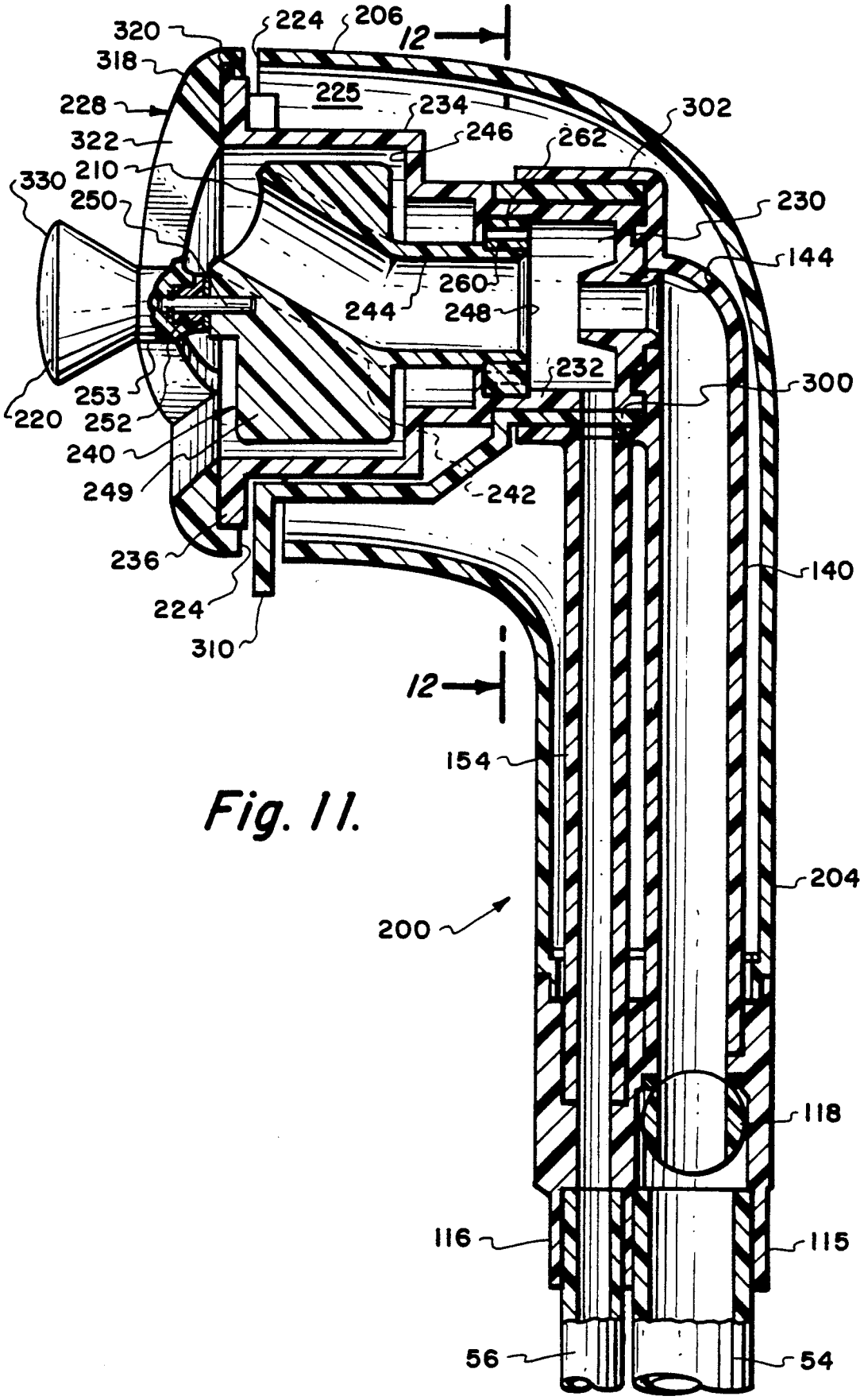
FIG. 11 is a sectional view taken substantially along the plane 11—11 of FIG. 10.

Attention is now called to FIGS. 10-12 which depict an alternative hand held unit 200 in accordance with the present invention. Note in FIG. 10 that the unit 200 is comprised of a housing 202 defining a handle portion 204 and a head portion 206. It should be apparent from a comparison of FIGS. 3 and 10 that the housing 202 is substantially similar to the housing 110 except at the front portion of the housing head portion 206. More specifically, whereas the discharge orifice 126 of the embodiment of FIG. 3 is fixed in position relative to the housing, the discharge orifice 210 of FIG. 10 is mounted so as to enable it to travel along a circular path, driven by the water stream discharged therefrom. Travelling discharge orifice devices are discussed in various ones of Applicants' aforecited patents. Particularly relevant is U.S. Pat. No. 4,715,071, (See, for example, FIG. 14) whose disclosure is by reference incorporated herein.

The hand held unit 200 further differs from the unit 52 of FIG. 3 in that it utilizes a single centrally located protuberance 220 configured to mechanically massage a user's body, as will be discussed hereinafter. The unit 200, further differs from the unit 52 of FIG. 3 in that the tub water inlets 224 to chambers 225 are arranged peripherally around the head portion 206, rearwardly of an annular front grill 228 upon which the protuberance 220 is mounted.

Figure 5:
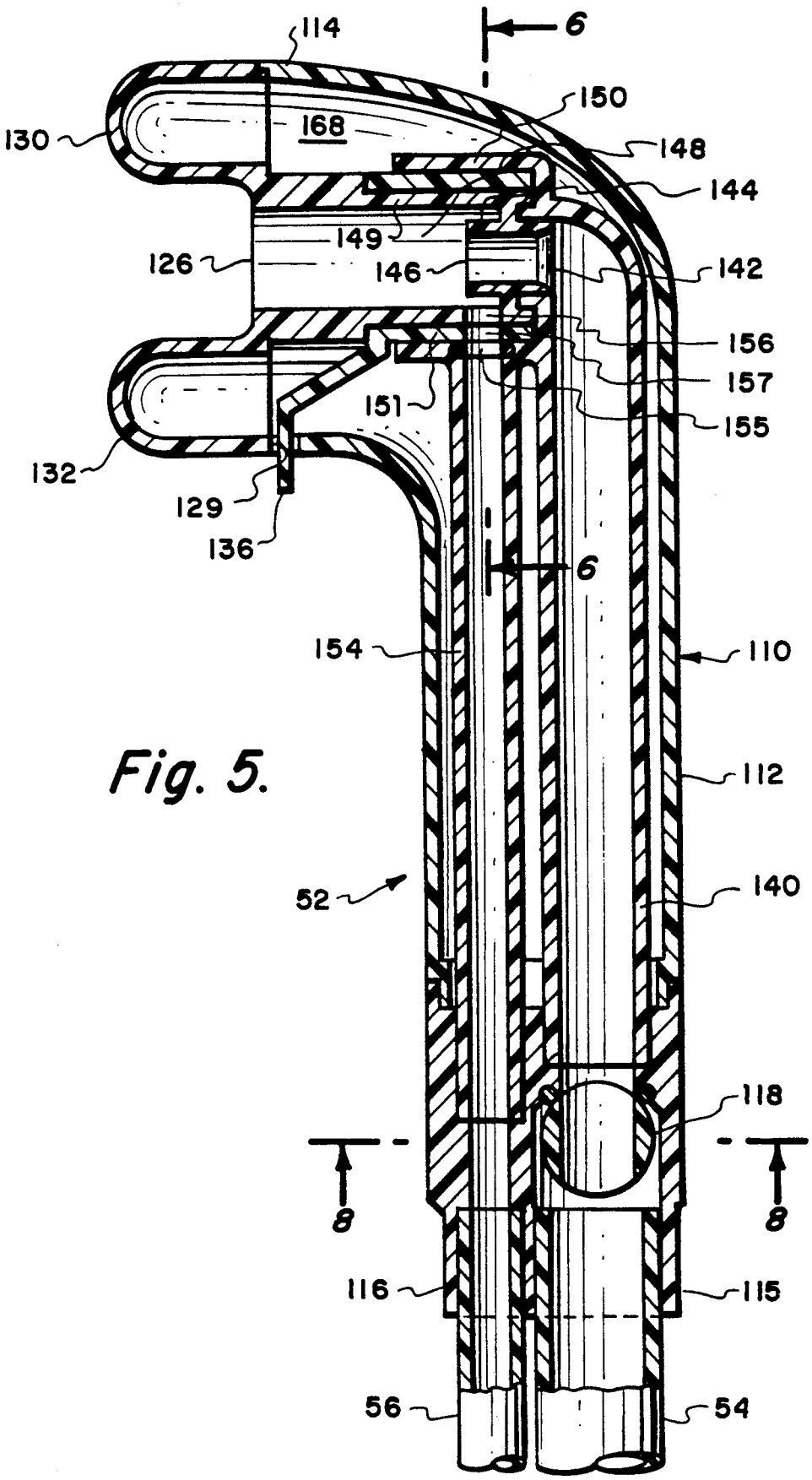
FIG. 5 is a sectional view taken substantially along the plane 5—5 of FIG. 4.

With continuing reference to FIG. 11 note that the handle portion 204 of unit 200 is substantially identical to the corresponding portion of unit 52 as depicted in FIG. 5. The difference between the two units primarily reside downstream of the nozzle 144 which discharges a water jet into a cavity 230 defined by wall 232. Whereas the cavity wall 149 of the aforedescribed unit 52 extended straight from the nozzle exit to the fixed discharge orifice 126, the cavity wall 232 of unit 200 is radially enlarged, e.g. at 234, to accommodate a rotatable conduit subassembly 240. The wall 234 has a flange 236 at its front end for supporting the grill 228. The subassembly 240 is substantially identical to the corresponding structure described in FIGS. 14-16 of Applicants' aforecited patent 4,715,071. Basically, the subassembly 240 includes an elongated rigid conduit 242 having a tubular supply section 244 and a tubular discharge section 246. The supply section 244 defines a supply orifice 248 mounted so that its axis is substantially aligned with the axis of nozzle 244. The tubular discharge section 246 opens into the aforementioned discharge orifice 210 and defines an axis misaligned with the axis of supply section 244. Drag plates 249 preferably extend substantially radially from the conduit 242. The forward or discharge end of the conduit 242 has a pin 250 staked therein and mounted for rotation in a bearing 252 formed in hub 253 of grill 228. the axis of pin 250 is aligned with the axis of The supply section 244 and thus the axis of nozzle 144.

The conduit supply section 244 has a reduced end (FIG. 11) upon which a bearing 260 is mounted. The bearing 260 is mounted for rotation within bushing 262. As described in Applicants' patent 4,715,071 the outer surface of bearing 260 is preferably eccentrically configured so that it contacts bushing 262 along a very narrow band to minimize friction loss therebetween and to permit the inward flow of tub water into the cavity 230. The orientation of the conduit discharge section 246 causes the stream discharged from orifice 210 to be in a direction having a tangential component which acts to rotate the conduit around an axis defined by pin 250 and bushing 262.

The unit 200 includes an entrainment mode selector valve comprising apertured valve member 300 mounted for rotation between support wall 302 and cavity wall 232. The position of the valve member 300 is controlled by a handle 310 accessible to the user. Operation of the handle 310 in unit 200 is identical to operation of the handle 136 in aforedescribed unit 52. The sectional views shown in FIGS. 6 and 7 respectively depicting the air entrainment mode and water entrainment mode for the unit 52 of FIG. 5 would be substantially the same for the unit 200 of FIG. 11.

The grill 228 includes an outer ring 318 which is secured, as by a removable bayonet connection at 320, to flange 236. The grill 228 includes one or more arms 322 extending from ring 318 to hub 253, accommodating the aforementioned bearing 252. The protuberance 220 is mounted on the hub 253 extending forwardly therefrom. The protuberance 220 preferably defines a smooth end surface 330 intended to be placed against the user's skin for providing mechanical massage thereat. More particularly, as the conduit it 242 is caused to rotate in response to the discharge of the water stream from discharge orifice 210, it will produce a reaction force tending to move the unit 200. By applying firm, but gentle, pressure of the protuberance surface 330 against the user's skin, the protuberance will mechanically massage the user while the water stream discharged from orifice 210 is providing a hydromassage.

From the foregoing, it should now be appreciated that two embodiments of a submergible hand held hydrotherapy apparatus have been disclosed herein for discharging a water stream to massage a user underwater. Both embodiments are characterized by the inclusion of an entrainment mode selector valve which enables the user to selectively cause the water jet produced by the internal supply nozzle to entrain either air or tub water. In the first embodiment, the discharge orifice is fixed in position relative to the unit housing whereas in the second embodiment, the discharge orifice is caused to travel along a circular path. In both embodiments, forwardly protecting protuberances are provided to space the discharge orifice from the user's body and thus prevent occlusion of the discharge orifice.

Although two specific embodiments of Applicants' invention are disclosed herein, it is recognized that various structural modifications and equivalents may occur to those skilled in the art and it is accordingly intended that such be included within the scope of the appended claims.

We claim:

1. Hydrotherapy apparatus suitable for use in a water tub having an electric pump for supplying a pressurized water flow, said apparatus including:

a housing configured to be held in a user's hand, said housing having a water supply inlet, and a discharge orifice oriented to discharge a water stream in a substantially forward direction exteriorly of said housing;

connecting means for coupling said pump pressurized water flow to said water supply inlet, said connecting means including a flexible hose;

means in said housing coupled said water supply inlet to said discharge orifice for enabling said discharge orifice to discharge said substantially forward directed water stream, said discharge orifice being mounted for movement along a travel path as said water stream is discharged therefrom;

protuberance means fixedly mounted on said housing projecting therefrom substantially in said forward direction, said protuberance means having a contact surface displaced forwardly from said discharge orifice for engaging a user's body to space said discharge orifice from said body, whereby a water stream discharged from said discharge orifice will produce a reaction force on said housing to cause said protuberance means contact surface to mechanically massage said user's body;

a rigid conduit including a tubular supply section defining a supply orifice and a tubular discharge section defining said discharge orifice; and means mounting said conduit with said supply orifice opening to said cavity whereby water supplied from said jet will flow through said conduit to said discharge orifice, said mounting mean including means supporting said conduit for rotation about an axis displaced from said discharge orifice whereby said discharge orifice will translate along a circular path.

2. Hydrotherapy apparatus suitable for use in a water tub having an electric pump for supplying a pressurized water flow, said apparatus including:

a housing configured to be held in a user's hand, said housing having a water supply inlet, an air supply inlet, and a discharge orifice oriented to discharge a water stream in a substantially forward direction exteriorly of said housing;

connecting means for coupling said pump pressurized water flow to said water supply inlet, said connecting means including a flexible hose;

a cavity defined in said housing;

nozzle means mounted in said housing having an entrance communicating with said water supply inlet and an exit for discharging a water jet along a defined axis into said cavity to produce a suction therein;

air port means coupled to said air supply inlet;

means in said housing coupling said cavity to said discharge orifice for enabling said discharge orifice to discharge said substantially forwardly directed water stream, said discharge orifice being mounted for movement along a travel path as said water stream is discharged therefrom;

protuberance means fixedly mounted on said hosing projecting therefrom substantially in said forward direction, said protuberance means having a contact surface displaced forwardly from said discharge orifice for engaging a user's body to space said discharge orifice from said body, whereby a water stream discharged from said discharge orifice will produce a reaction force on said housing to cause said protuberance means contact surface to mechanically massage said user's body;

a rigid conduit including a tubular supply section defining a supply orifice and a tubular discharge section defining said discharge orifice; and means mounting said conduit with said supply orifice opening to said cavity whereby water supplied from said jet will flow through said conduit to said discharge orifice, said mounting means including means supporting said conduit for rotation about an axis displaced from said discharge orifice whereby said discharge orifice will translate along a circular path.

3. The apparatus of claim 2 wherein said housing further includes a tub water inlet;

a tub water port means coupled to said tub water inlet; and user operable valve means for selectively and alternatively opening said air port means and said tub water port means to said cavity for selectively and alteratively entraining air and tub water with said water jet to form said water stream;

4. Hydrotherapy apparatus suitable for use in a water tub having an electric pump for supplying a pressurized water flow, said apparatus including:

a housing configured to be held in a user's hand, said housing having a water supply inlet, a tub water inlet, and a discharge orifice oriented to discharge a water stream in a substantially forward direction exteriorly of said housing;

connecting means for coupling said pump pressurized water flow to said water supply inlet, said connecting means including a flexible hose;

a cavity defined in said housing;

nozzle means mounted in said housing having an entrance communicating with said water supply inlet and an exit for discharging a water jet along a defined axis into said cavity to produce a suction therein;

tub water port means coupled to said tub water inlet;

means in said housing coupling said cavity to said discharge orifice for enabling said discharge orifice to discharge said substantially forwardly directed water stream, said discharge orifice being mounted for movement along a travel path as said water stream is discharged therefrom;

protuberance means fixedly mounted on said housing projecting therefrom substantially in said forward direction, said protuberance means having a contact surface displaced forwardly from said discharge orifice for engaging a user's body to space said discharge orifice from said body, whereby a water stream discharged from said discharge orifice will produce a reaction force on said housing to cause said protuberance means contact surface to mechanically massage said user's body;

a rigid conduit including a tubular supply section defining a supply orifice and a tubular discharge section defining said discharge orifice; and means mounting said conduit with said supply orifice opening to said cavity whereby water supplied from said jet will flow through said conduit to said discharge orifice, said mounting mean including means supporting said conduit for rotation about an axis displaced from said discharge orifice whereby said discharge orifice will translate along a circular path.

5. The apparatus of claim 1 further including water supply valve means located between said water supply inlet and said discharge orifice, said water supply valve means including a user operable control member extending exteriorly of said housing.

6. The apparatus of claim 1 wherein said connecting means includes fitting means adapted to be mounted on a water tub wall for coupling said pump pressurized water flow to a first end of said flexible hose.

7. The apparatus of claim 2 wherein said connecting means includes fitting means adapted to be mounted on a water tub wall for coupling said pump pressurized water flow to a first end of said flexible hose.

8. The apparatus of claim 4 further including a water supply valve located between said water supply inlet and said nozzle means, said water supply valve including a user operable control member extending externally of said housing.

9. The apparatus of claim 4 wherein said connecting means includes fitting means adapted to be mounted on a water tub wall for coupling said pump pressurized water flow to a first end of said flexible hose.

* * * * *